United States Patent [19]

Eynck

[11] Patent Number: 4,982,385

[45] Date of Patent: Jan. 1, 1991

[54] ACOUSTIC DECOUPLER FOR A SONAR ARRAY

[75] Inventor: John J. Eynck, Severna Park, Md.

[73] Assignee: Westinghouse Electric Corp., Pittsburgh, Pa.

[21] Appl. No.: 437,950

[22] Filed: Nov. 17, 1989

[51] Int. Cl.[5] ..... H04R 1/00

[52] U.S. Cl. ..... 367/151; 367/162; 367/165; 367/173; 367/176

[58] Field of Search ..... 367/151, 162, 165, 173, 367/176

[56] References Cited

U.S. PATENT DOCUMENTS

| | | | |
|---|---|---|---|
| 1,067,207 | 7/1913 | Williams | 181/140 |
| 1,378,420 | 5/1921 | Merritt | 181/175 |
| 2,000,806 | 5/1935 | White | 181/30 |
| 2,503,400 | 4/1950 | Mason | 181/0.5 |
| 3,748,167 | 7/1973 | Lepor | 117/72 |
| 3,834,487 | 9/1974 | Hale | 52/144 |
| 4,031,502 | 6/1977 | Lefaudeux et al. | 367/151 |
| 4,160,230 | 7/1979 | Cluzel | 367/151 |
| 4,164,727 | 8/1979 | Morris | 181/0.5 |
| 4,390,976 | 1/1983 | Eynck | 367/153 |
| 4,399,526 | 8/1983 | Eynck | 367/151 |
| 4,450,544 | 5/1984 | Denaro et al. | 367/176 |
| 4,759,000 | 7/1988 | Reitz | 367/176 |
| 4,821,243 | 4/1989 | Caprette | 367/151 |

FOREIGN PATENT DOCUMENTS

| | | |
|---|---|---|
| 958139 | 5/1964 | United Kingdom . |
| 2063007 | 5/1981 | United Kingdom . |

*Primary Examiner*—Charles T. Jordan
*Assistant Examiner*—J. Woodrow Eldred
*Attorney, Agent, or Firm*—D. Schron

[57] ABSTRACT

An inner decoupler for a sonar array including a linear array of hydrophones and consisting of an alternating multi-layer configuration of acoustic compliance elements in the form of acoustic baffles and acoustic non-compliance elements in the form of water or other acoustic mass-like element located between the hydrophones and the outer surface of a ship's hull. This arrangement embodies an acoustic low pass filter between the hydrophones and the hull and operates to enhance incoming signals incident to the sonar array while attenuating signals such as structure borne noise generated from the opposite or hull side of the array.

9 Claims, 5 Drawing Sheets

ACOUSTIC DECOUPLER FOR A SONAR ARRAY

BACKGROUND OF THE INVENTION

This invention relates generally to acoustic signal conditioning apparatus and more particularly to an inner decoupler for enhancing incoming signals incident on hull mounted sonar arrays while attenuating signals generated and emanating from the opposite side of the sonar array Sonar comprises well known apparatus having both civilian and military applications. In order to provide signal enhancement of the incident signals, acoustic decouplers have been developed to improve the signal-to-noise ratio on hull mounted sonar arrays. In order to achieve this desired result, acoustic decouplers in the past have been designed to perform two functions, namely: (1) to provide, in conjunction with a signal conditioning plate, the proper impedance backing for one or more hydrophones included in the array; and (2) to isolate or decouple structure borne noise which emanates from a ship's hull and which tends to undesirably degrade the overall performance of the system.

With regard to the first function, an ideal signal conditioning device is one which when placed directly behind the hydrophones operates to enhance the signal response at all frequencies without introducing phase shifts. In known prior art apparatus, thick steel plates having pressure release, i.e. low impedance, backings have been used to approach this end. However, as the need for improved performance requires the use of lower and lower operating frequencies, the thicknesses and weight requirements for the steel plate structures become prohibitive from a practical standpoint and alternative means have been resorted to obtain signal conditioning, i.e. signal enhancement A fluid layer has also been known to be used as a stand-off between a signal conditioning plate and the hydrophones. The mass of the fluid layer may be traded for the mass of the signal conditioning plate with some benefit in low frequency performance; however, the frequency bandwidth over which signal gain may be obtained will be reduced. In the extreme case where fluid mass totally replaces the mass exhibited by the signal conditioning plate, the low impedance backing is usually positioned at a one-quarter wavelength distance from the hydrophone to maximize signal gain. The main disadvantage of this approach is that the bandwidth is seriously curtailed compared to that obtained with other alternatives.

With respect to the second function, low impedance devices of diverse forms and types are known and have been used extensively to decouple structure borne noise from the sonar array. Nevertheless in applications where resistance to hydrostatic pressure is a factor, acoustic compliance should be maintained under hydrostatic pressure. However, this function becomes evermore difficult as one resorts to ever lower frequencies of operation.

Many different devices have been proposed and/or considered to provide signal conditioning for sonar arrays. The great majority require the use of a low impedance termination to provide a high transmission loss to the system. Basic types include absorptive baffles, compliant tube baffles and sound diffusers.

Absorptive type baffles remove unwanted energy from the system and, as is well known, come in many varieties. Conventional rubber/air absorbers are very effective in their design pressure/frequency/temperature range, but are usually pressure sensitive and are otherwise limited in their frequency response. Absorbers which provide a gradual impedance transition from front to back through geometric shapes such as wedges or cones, are also well known. For low frequency applications, however, the dimensions of the wedges which would be required for effective signal conditioning exceed practical limits. Several other versions of gradual impedance transition coatings have been widely proposed, but their limitation is one of size relative to an acoustic wavelength for the lowest frequency of interest.

With respect to compliant tube baffles, such elements utilize the mechanical resonances of squashed metallic tubes encased within viscous elastic matrices to attain dynamic compliance. Compliant tube baffles have the advantage that they are essentially pressure insensitive. Their major limitation is their excessive weight, and in some instances, fatigue cracking of the tubes result when subjected to pressure cycling or shock tests. Other drawbacks include the high manufacturing costs involved, difficulty in installation, and the narrow frequency coverage achieved thereby.

Other known approaches for achieving signal conditioning involve the use of sound diffusion through multiple scattering to make noise more random. Undesired sound noise can either add coherently or randomly to an acoustic signal. In particular, structure borne noise is detrimental if its discrete frequency components add coherently, i.e., in phase, to the acoustic signal being detected. This requires complex electronic detectors to discriminate against coherent noise interference. On the other hand, random noise can be dealt with through time averaging or other standard signal processing techniques. Signal processing is burdensome, however, and thus comprises an undesired approach.

Accordingly, it is an object of the present invention to provide an improvement in underwater communication and detection apparatus.

It is a further object of the invention to provide an improvement in sonar apparatus.

It is another object of the invention is to provide an acoustic decoupler for a sonar array which combines both a signal conditioning function as well as a structure borne noise decoupling function.

And it is still a further object of the invention to provide an improved sonar array of a simple and efficient design for improving the signal-to-noise ratio of hull mounted arrays.

SUMMARY

The foregoing and other objects and advantages are achieved by an inner decoupler located between the sonar array and the submerged hull of a vessel and comprised of a plurality, i.e. two or more, of acoustic compliance elements which are separated by acoustic non-compliance or mass elements to control the phase response of the system and implement an acoustic low pass filter which operates to enhance incident acoustic signals while attenuating signals traveling in the opposite direction from the surface of the vessel's hull. In a first embodiment, a triple-layer baffle structure is provided which includes a high frequency baffle, a middle frequency baffle, and a low frequency baffle located inwardly behind a linear array of hydrophones and being mutually separated by an acoustically non-compliance means, preferably water. The high frequency baffle is closest to the sonar array, while the low frequency baffle is closest to the surface of the hull. The baffle elements may or may not be identical depending on the design. In a second embodiment, a double-layer baffle configuration is provided which is used in tandem to provide a symmetrical arrangement of a pair of compliance elements in the form of absorptive/reflective baffles located on either side of a structural support member of the vessel's hull, with each pair of baffles being separated by a layer of acoustic non-compliance material, typically water. In each instance, a water stand-off layer is additionally located between the outermost i.e. high frequency baffle element and the sonar array positioned in front of the decoupler.

BRIEF DESCRIPTION OF THE DRAWINGS

The details of the invention will become more readily understood when the following detailed description of the invention is taken in conjunction with the accompanying drawings wherein.

DETAILED DESCRIPTION OF THE INVENTION

Figure 1:
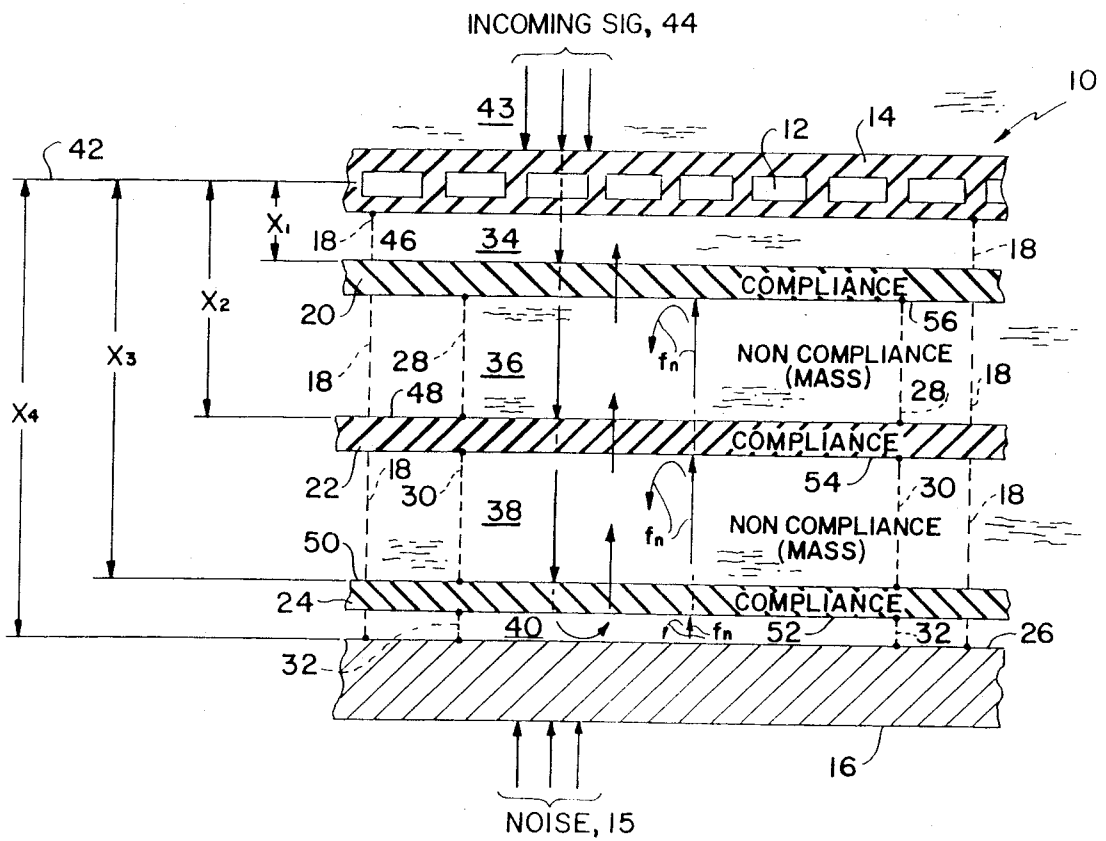
FIG. 1 is a partial transverse sectional view schematically illustrative of one preferred embodiment of the invention.

Referring now to the drawings wherein like reference numerals refer to like components throughout, reference is first made to FIG. 1 where there is shown what is being termed a triple-layer baffle configuration and which embodies the inventive concept of alternate layers of acoustic compliance elements and acoustic non-compliance elements and forming an acoustic low pass filter thereby which is located between an outboard sonar array and the hull of a vessel.

As shown in FIG. 1, reference numeral 10 denotes a sonar array including a plurality of hydrophones 12 embedded end-to-end in a layer of acoustically conductive material 14 which has an impedance that matches sea water. The sonar array 10, moreover, is mounted exteriorally of the submerged hull 16 of a vessel or ship which is typically comprised of metal such as steel. The sonar array 10 is typically attached to the hull 16 by means of conventional mechanical mounting structures which are schematically shown by reference numeral 18.

Upon reviewing the various baffling and signal conditioning alternatives presently known in the art, it was observed that none met the desired criteria of obtaining an extremely low frequency response coupled with a minimum of hardware weight. Accordingly, three acoustic compliance means or elements in the form of acoustically partially absorptive, partially reflective and partially transmissive baffles 20, 22 and 24 are located between the sonar array 10 and the outer surface 26 of the hull 16 and being mounted thereon by means of standard hardware shown schematically by reference numerals 28, 30 and 32.

Alternating between the baffles 20, 22 and 24, the sonar array 10, and the hull 16, are respective acoustic noncompliance means 34, 36, 38 and 40 comprised of relatively non-compressive acoustic mass elements preferably, but not limited to, sea water in the regions on either side of the baffles 20, 22 and 24, respectively. The portion of water 34 also constitutes the stand-off region between the array and outermost baffle 20. The baffles are shown comprised of generally flat planar elements, but can be curved when desired, and act to partially reflect and transmit predetermined acoustical frequencies of incident acoustic signals 44 received from an external source, not shown, and applied to their respective external surfaces. The baffle 20, for example, is designed to partially absorb and partially reflect acoustic energy at all frequencies, but primarily at the relatively higher frequencies of operation, while at the same time being partially transparent, at least, to middle and lower frequencies. The intermediate baffle 22 is designed to partially absorb and reflect energy in the mid frequency range while being partially transparent, at least, to the relatively lower frequencies. The innermost baffle 24 is designed to attenuate and reflect primarily the relatively low frequencies. The distances $x_1$, $x_2$ and $x_3$ from the reference plane 42 to the outer surfaces 46, 48 and 50 of the baffles 20, 22 and 24 are selected so that the partially reflected and/or transmitted signals from each of the three layers arrive in phase back to the reference plane 42 of sonar array 10 providing what is termed "signal conditioning" or "enhancement" of the incoming acoustic signals incident on the sonar array 10.

With respect to the structure borne noise 15 emanating from the hull 16, however, these signals are both reflected and transmitted through the baffle elements starting with the innermost baffle element 24 and then the middle baffle 22 and then to the outer baffle 20 so that they are mutually out of phase and thus effectively cancel each other prior to reaching the plane 42 of the hydrophones 12 from the rear side.

As noted above, a signal conditioning plate has been utilized in prior art apparatus to provide a reflective surface for the acoustic pressure comprising the incident or incoming signal $P_i$ such that the inphase reflections $P_r$ therefrom will enhance the incoming signal. This can be expressed as:

$$GAIN = 10 \log_{10}[(P_i + P_r)/P_i]^2 \quad (1)$$

and can amount to, for example, 6dB in gain. An indication of the performance requirements for a hydrophone 12 directly in front of a baffle, for example, the baffle 20, with a reflection factor R and phase angle $\theta$ is also easily derived. The hydrophone response H is the sum of the incident and reflect waves, $p + pR \exp(j\theta)$ from which the magnitude of the hydrophone response can be expressed as:

$$H = (1 + R^2 + 2R \cos\theta)^{\frac{1}{2}} \quad (2)$$

It can be seen from the above expressions that a high reflection factor approaching unity, i.e. the reflected signal is in phase with the incoming signal, is required to attain signal enhancement. Signal conditioning plates do this by virtue of their mass. The main impediment to this type of device, however, is that as the incident frequencies become lower and lower, the required mass which must be utilized becomes prohibitively large from practical considerations.

Accordingly, the present invention resorts to the use of acoustic compliance members in the form of baffle elements. The baffle elements 20, 22 and 24 must be able to withstand the environment as well as mechanical abuse, as required, but otherwise their composition and/or construction is not restricted by design. They may comprise simply rubber or plastic layers with or without air voids, syntactic foams, or composite structures providing both structural support and acoustic performance. If these components are expected to perform under varying hydrostatic pressures, however, the baffle elements 20, 22 and 24 must be constructed to be pressure insensitive. One such approach utilizes the one quarter wavelength resonance of rubber elements encased within compartments or cells in rigid panels to attain the required phase shift. The rigid enclosure ensures insensitivity to hydrostatic pressure while still permitting a favorable response to the incident acoustic energy. The pattern of cells must be configured in either flat or slightly curved panels, as required. The rubber elements are bonded to either one of the panel faces, but their free end can be terminated by air. The free end would be mass-loaded for tuning purposes, using lead shot or other suitable substitutes in a predetermined fashion. The resonance frequency of each element would then be adjusted, as desired, but the placement of the individual elements within the pattern of cells would be determined experimentally to obtain broadband performance.

Figure 2:
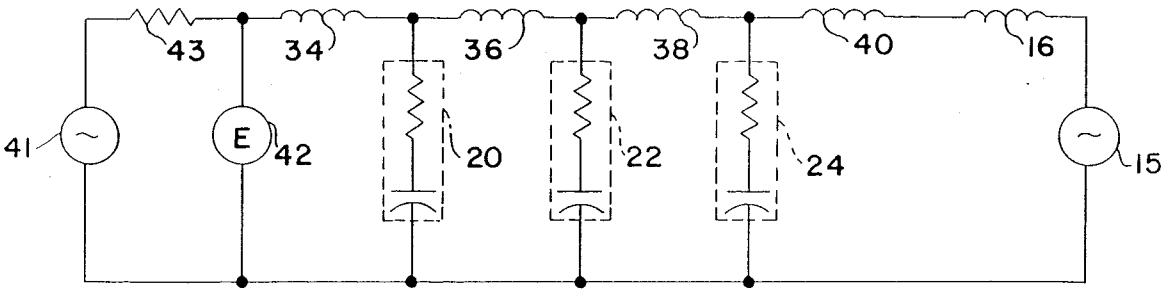
FIG. 2 is an electrical schematic diagram which is illustrative of the electrical analog for the embodiment of the invention shown in FIG. 1.

The structure of FIG. 1 in effect embodies an acoustic low pass filter which has an electrical analog as shown in FIG. 2. Referring now to FIG. 2, the electrical schematic illustrated there discloses an R-L-C low pass filter where the acoustic compliance means, i.e. the baffles 20, 22 and 24, are represented by series resistance-capacitance impedances while the acoustic non-compliance means, i.e., the acoustic masses comprising the intermediate regions of sea water 34, 36, 38 and 40, are represented by inductances. The steel hull 16 is illustrated as another inductance in series with the acoustic mass 40. The local structure borne noise emanating from the hull is shown as a signal generator 15 coupled to the inductor representing the steel hull 16. On the other side of the filter, the incident acoustic signals which are propagating toward the sonar array 10 are represented by a signal generator 41 with the water medium external to the sonar array being represented by a fixed resistor 43. The pressure incident on the linear array of hydrophones 12 shown in FIG. 1 is represented by a signal voltage "E" designated by reference numeral 42. It can be seen, therefore, that a simple low pass acoustic filter is embodied in the structure shown in FIG. 1. When desirable, this filter can be further modified in accordance with principles set forth herein to conform to any type of known filter design, e.g. Bessel, Butterworth, Chebyshev, etc.

Figure 3:
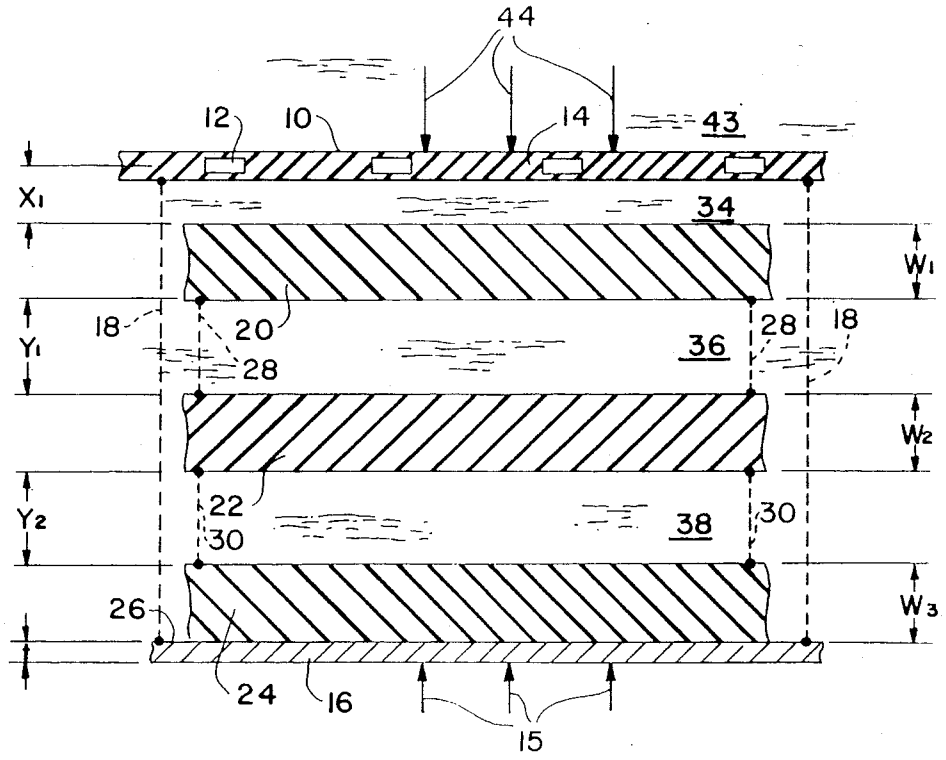
FIG. 3 is a partial sectional view illustrative of an experimental version of the embodiment shown in FIG. 1.

Referring now to FIG. 3, shown thereat is a variation of the embodiment illustrated in FIG. 1 and comprises an experimental version thereof which has been evaluated acoustically but not optimized and comprises a modification wherein the low frequency baffle member 24 is now attached directly to the outer surface 26 of a hull 16 which has a thickness $t=0.5$ inches. Further, each of the three acoustic compliance members which comprise the high frequency, middle frequency and low frequency baffles 20, 22 and 24, respectively, have a width dimension $w_1$, $w_2$, $W_3=4.0$ in. with a mutual separation therebetween of $y_1$, $y_2=5.0$ in. which is comprised of water, typically sea water. The linear array of hydrophones 12 included in the sonar array 10, moreover, have a standoff distance $x_1=3.0$ inches from the high frequency baffle 20, with an intervening layer 34 of water provided between the sonar array 10 and the planar baffle 20.

Figure 4:
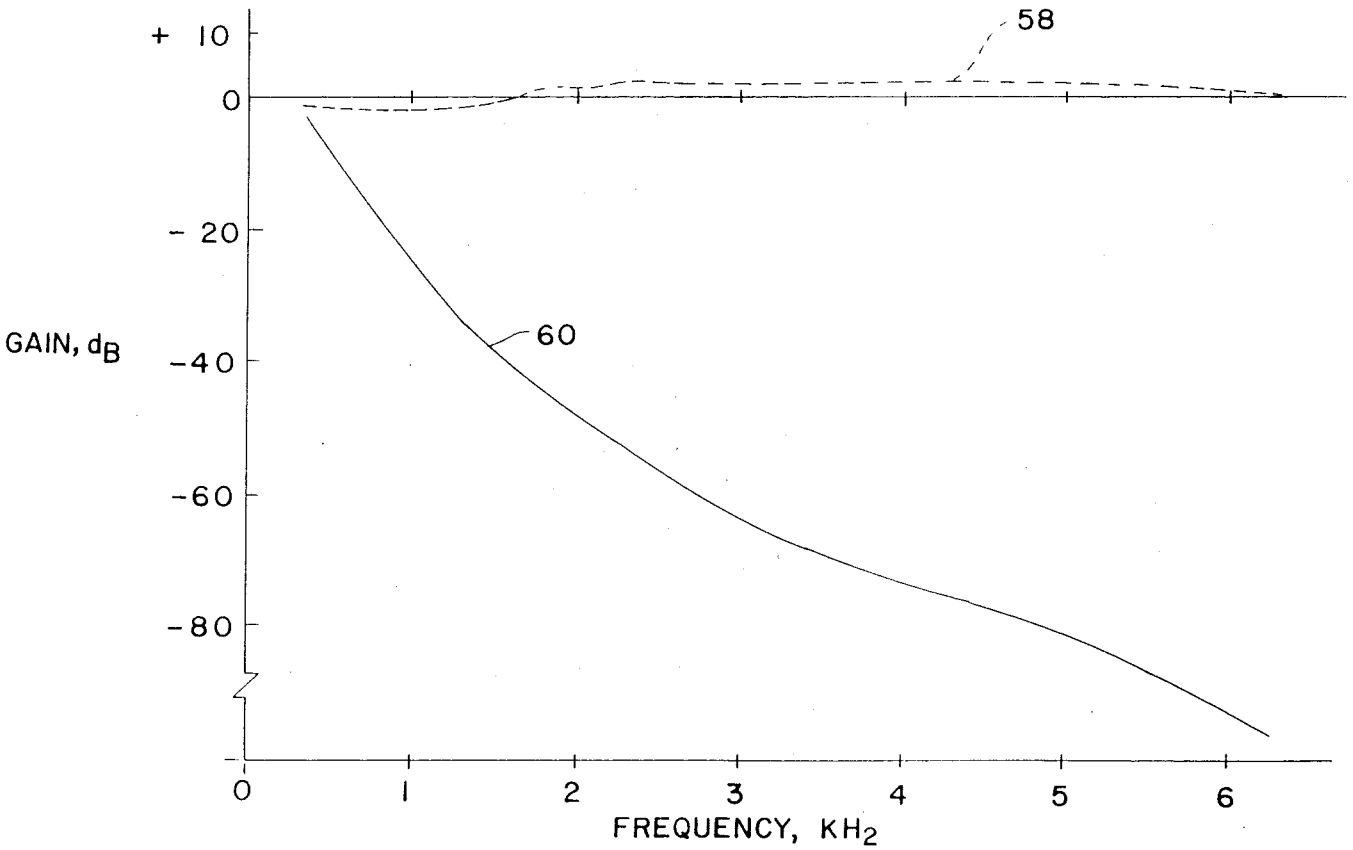
FIG. 4 is a graph illustrative of the operational characteristics of the embodiment shown in FIG. 3.

Performance of the design illustrated in FIG. 3 yielded a set of characteristic curves which is shown in FIG. 4 wherein reference numeral 58 is illustrative of the signal enhancement obtained above 1.5KHz, while reference numeral 60 is illustrative of the attenuation of structure borne noise down to a frequency or 0.5KHz.

Figure 5:
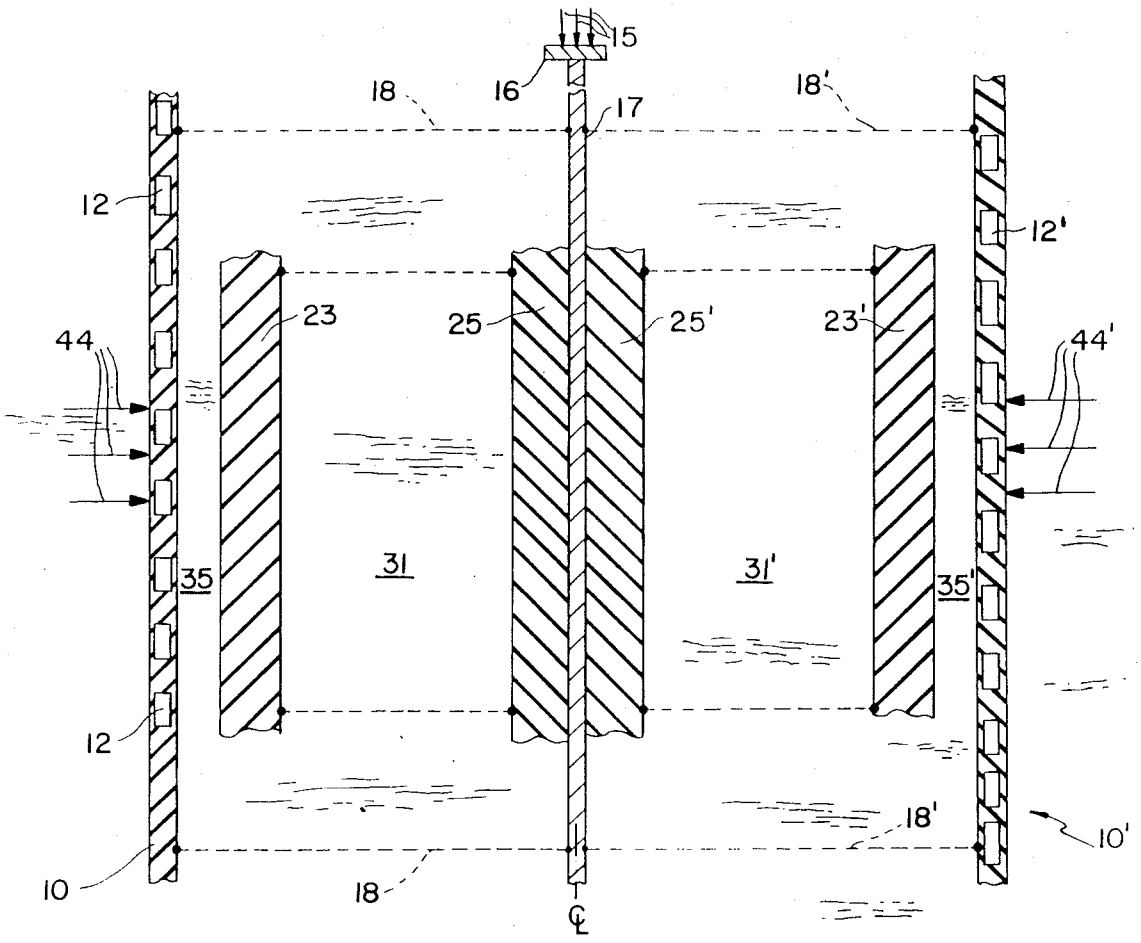
FIG. 5 is a partial transverse cross sectional view of another preferred embodiment of the invention.

Another embodiment of the invention is shown in FIG. 5 and comprises a variant of the simple double-layer or the simple triple-layer baffle configuration shown in FIG. 1 and comprises what is termed a tandem double-layer baffle decoupler and wherein a dual symmetrical arrangement of alternating layers of compliance means and non-compliance means are located between dual sonar arrays 10 and 10' secured on opposite sides of a main structural support member 17 which may be, for example, a skeg. The sonar arrays are located outwardly of the structural support member 17 and are attached either thereto or to the ship hull 16 by hardware which are shown schematically by reference numerals 18 and 18'.

What is significant about the acoustic decoupler shown in FIG. 5, however, is that two pairs of baffles 23, 23', and 25, 25' are symmetrically located on either side of an outer line which is shown comprising the structural support member 17 which additionally acts as a mass. The baffle pair 25 and 25' are secured directly to the member 17, while being separated from the baffles 23 by non-compliance water layers 31 and 31' which also act as masses. Additionally, standoff layers of water 35 and 35' provide mass reactances between the hydrophone arrays 10 and 10' and the baffles 23 and 23'.

What is achieved in the arrangement shown in FIG. 5 is also a low pass acoustic filter which operates to attenuate structure borne noise emanating outwardly from the structural support member 17, while at the same time enhancing incident signals received by the particular sonar array 10 or 10' in the same manner as described with respect to the embodiment shown in FIG. 1, while at the same time decoupling from the same array signals arriving from the opposite direction.

Thus the embodiments of the invention shown and described implement both signal conditioning and noise decoupling functions to the sonar arrays by means of low pass acoustic filters. The sound absorbing/reflecting baffle layers are used to obtain the necessary phase shifts while the spatial arrangement of the multiple baffles permit broadband performance. The use of the intervening liquid mass layers enables the attainment of low frequency performance without excessive weight or massive signal conditioning plates heretofore required.

Having thus shown and described what is at present considered to be the preferred embodiments of the invention, it should be noted that the same has been made by way of illustration and not limitation. Accordingly, all alterations, modifications and changes coming within the spirit and scope of the invention are herein meant to be included.

I claim:

1. An acoustic decoupler for hydrophone apparatus included in a soner array located exteriorly of a submerged hull surface of a vessel comprising:

an acoustic low pass signal filter located between said hydrophone apparatus and a hull surface member, said low pass signal filter further comprising, a plurality of mutually spaced apart acoustic compliance means located on the hull surface side of said hydrophone apparatus, said compliance means comprising a relatively high frequency baffle located adjacent said sonar array, a low frequency baffle located adjacent said hull surface member, and a middle frequency baffle located intermediate said high frequency baffle and said low frequency baffle; and acoustic non-compliance means located between adjacent compliance means of said plurality of compliance means, said non compliance means comprising an acoustic non-compressive liquid mass located between said baffles as well as between said sonar array and said high frequency baffle layer, whereby acoustic signals incident on said hydrophone apparatus from a remote source are enhanced while locally generated structure borne signals including noise propagating outwardly from said hull surface toward said hydrophone apparatus are attenuated.

2. The acoustic decoupler according to claim 1 wherein said hull surface member comprises a portion of said hull surface.

3. The acoustic decoupler according to claim 2 wherein said hydrophone apparatus comprises a plurality of hydrophones arranged in a linear array.

4. The acoustic decoupler according to claim 2, wherein said liquid mass comprises water and additionally including an acoustic non-compressive mass of water separating said hull surface and said low frequency baffle.

5. The acoustic decoupler according to claim 1 wherein said hull surface member comprises a structural support member of said vessel located exteriorly of said hull surface; and a said acoustic low pass signal filter located on each side of said structural support member.

6. The acoustic decoupler according to claim 5 wherein said hydrophone apparatus comprises a plurality of hydrophones arranged in a respective linear array located exteriorly of each high frequency baffle.

7. The acoustic decoupler according to claim 5 wherein said acoustic non-compression liquid mass comprises.

8. The acoustic decoupler according to claim 7 and additionally including a mass of water between said hydrophone apparatus and each high frequency baffle.

9. The acoustic decoupler according to claim 5 and wherein said structural support member comprises a skeg which additionally operates as a mass between each low frequency baffle.

* * * * *